US011976583B2

(12) United States Patent
Kitamura et al.

(10) Patent No.: US 11,976,583 B2
(45) Date of Patent: May 7, 2024

(54) RESERVOIR TANK FOR COOLANT

(71) Applicant: HONDA MOTOR CO., LTD., Tokyo (JP)

(72) Inventors: Miyo Kitamura, Tokyo (JP); Shinji Shimoyama, Tokyo (JP); Keijiro Koide, Tokyo (JP); Masahiro Kato, Tokyo (JP); Tatsuya Kurimoto, Tokyo (JP); Tatsuki Tanaka, Tokyo (JP); Koji Sato, Tokyo (JP); Takumi Tokinoya, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/457,405

(22) Filed: Aug. 29, 2023

(65) Prior Publication Data

US 2024/0077015 A1 Mar. 7, 2024

(30) Foreign Application Priority Data

Sep. 2, 2022 (JP) ..... 2022-139808

(51) Int. Cl.
*F01P 11/02* (2006.01)

(52) U.S. Cl.
CPC ..... *F01P 11/0204* (2013.01)

(58) Field of Classification Search
CPC ..... F01P 11/0204
USPC ..... 123/41.01
See application file for complete search history.

(56) References Cited

U.S. PATENT DOCUMENTS

| | | | | |
|---|---|---|---|---|
| 5,357,909 | A * | 10/1994 | Attinger | F01P 11/029 165/104.32 |
| 9,856,777 | B2 * | 1/2018 | Camera | F01P 11/029 |
| 11,035,286 | B2 * | 6/2021 | Mark | F01P 7/165 |
| 2010/0206882 | A1 * | 8/2010 | Wessels | F01P 11/029 220/562 |
| 2015/0144079 | A1 * | 5/2015 | Iafrate | B01D 19/00 96/187 |
| 2019/0249591 | A1 * | 8/2019 | Nakayama | F01P 11/0276 |
| 2020/0149464 | A1 * | 5/2020 | Trythall | F01P 11/0204 |

FOREIGN PATENT DOCUMENTS

JP S61-88025 U 6/1986

* cited by examiner

*Primary Examiner* — Sizo B Vilakazi
(74) *Attorney, Agent, or Firm* — Carter, DeLuca & Farrell LLP

(57) ABSTRACT

The present invention relates to a reservoir tank for coolant that stores the coolant for cooling an internal combustion engine. The reservoir tank includes: a tank chamber that stores the coolant; an opening, which is disposed in an upper part of the tank chamber, through which the coolant flows in and flows out, and in a circumferential wall of which a breathing hole is formed; and a first communication passage, a second communication passage, and a third communication passage that respectively communicate with the opening and the tank chamber.

5 Claims, 6 Drawing Sheets

RESERVOIR TANK FOR COOLANT

BACKGROUND

Technical Field

The present invention relates to a reservoir tank for coolant that stores the coolant for cooling an internal combustion engine.

Related Art

A reservoir tank is connected with a cooling circuit through which coolant for cooling an internal combustion engine circulates, and has a function of storing and releasing the coolant in accordance with a state of the temperature or pressure in the cooling circuit. Thus, a breathing hole (vent hole) for absorbing an influence of expansion and contraction of the air due to a change in the temperature is usually provided in an upper part of the reservoir tank. In addition, the reservoir tank is provided in an engine room, and when a vehicle travels on a rough road or the like, the liquid surface of the coolant in the reservoir tank may vibrate largely, and the coolant may leak out of the breathing hole. Hence, it is necessary to prevent this leakage.

As a conventional reservoir tank, for example, the reservoir tank disclosed in JP S61-88025 U is known. This reservoir tank includes a main chamber and an auxiliary chamber that is adjacent to the main chamber and that has a smaller cross-sectional area (horizontal cross-sectional area). The lowermost parts of the main chamber and the auxiliary chamber communicate with each other through a first communication passage, and the uppermost parts communicate with each other through a second communication passage. A passage area of the first communication passage is considerably larger than that of the second communication passage. The coolant flows into and flows out of the reservoir tank through the main chamber, while the internal combustion engine is operating. In addition, an opening for injecting (replenishing) the coolant is formed in an uppermost part of the auxiliary chamber, and a cap is detachably attached to the opening. Further, the inside of the cap is filled with a filter medium for gas-liquid separation, and a breathing hole (communication hole) for ventilating the reservoir tank is formed in a lateral side part.

CITATION LIST

Patent Literature

Patent Literature 1: Japanese Utility Model Application Laid-Open Publication No. S61-88025 U

SUMMARY

In the above-described conventional reservoir tank, the cross-sectional area of the auxiliary chamber or the passage area of the first communication passage is not so small. Hence, while the vehicle is traveling on a rough road or the like, when vibration or impact acts on the reservoir tank, the coolant flows out of the main chamber through the first communication passage to the auxiliary chamber or directly moves inside the auxiliary chamber in a vertical direction. Therefore, liquid surface vibration of the coolant in the auxiliary chamber cannot be sufficiently suppressed. As a result, the coolant may reach an uppermost part of the auxiliary chamber, and may leak to the outside through the breathing hole. On the other hand, in order to avoid such a defect, for example, it is conceivable to form the vicinity of the breathing hole of the auxiliary chamber into a labyrinth structure to suppress the leakage of the coolant. However, in such a case, the number of component parts for forming the labyrinth structure increases, thereby leading to an increase in cost.

The present invention has been made to address such drawbacks, and has an object to provide a reservoir tank for coolant with a relatively simple configuration so as to be capable of sufficiently suppressing liquid surface vibration of the coolant in the reservoir tank and preventing the coolant from leaking out of a breathing hole.

In order to achieve this object, according to a first aspect of the present invention, a reservoir tank 1 for coolant that stores the coolant for cooling an internal combustion engine is provided, the reservoir tank including: a tank chamber 4 that stores the coolant; an opening 5 which is arranged in an upper part of the tank chamber 4, through which the coolant flows in and flows out, and in a circumferential wall of which a breathing hole 11 is formed; and a first communication passage 6, a second communication passage 7, and a third communication passage 8 that respectively communicate with the opening 5 and the tank chamber 4.

The reservoir tank for the coolant in the present invention includes the tank chamber that stores the coolant, and the opening which is disposed above the tank chamber, and through which the coolant flows in and flows out, and the breathing hole is formed in a circumferential wall of the opening. The opening and the tank chamber communicate with each other through the first to third communication passages. According to this configuration, for example, while the vehicle is traveling on a rough road, when vibration or impact acts on the reservoir tank, liquid surface vibration of the coolant occurs in the tank chamber. Then, the coolant moves from the tank chamber through at least one of the first to third communication passages to the opening side on an upper side.

In this case, when the coolant moves through all the first to third communication passages, the coolant moves upward while being dispersed in the first to third communication passages. Accordingly, unlike the conventional case where the coolant directly moves upward in the auxiliary chamber, the liquid surface vibration in the vertical direction can be sufficiently suppressed. Neither the liquid surface of the coolant nor a droplet reaches the breathing hole formed in the opening. Therefore, the coolant can be prevented from leaking out of the breathing hole. In addition, the reservoir tank in the present invention has a simple configuration, as compared with the conventional one having a labyrinth structure.

According to a second aspect of the present invention, in the reservoir tank 1 for the coolant described in the first aspect, the first communication passage 6 and the second communication passage 7 respectively include lateral passage portions 6*a* and 7*a* extending in a horizontal direction with end portions facing each other below the opening 5, and the third communication passage 8 extends downward from below the opening 5.

According to this configuration, when the liquid surface vibrates in the tank chamber, in a case where the coolant flows from the tank chamber through the first to third communication passages, the coolant flows into below the opening respectively from one side in the horizontal direction through the lateral passage portion of the first communication passage, from an opposite side in the horizontal direction through the lateral passage portion of the second communication passage, and from below through the third communication passage. In this manner, the coolant flows into below the opening from three directions different from one another. Thus, the flows of the coolant interfere with one another, and the coolant hardly flows around the opening on an upper side, so that the coolant can be prevented from leaking out of the breathing hole in a more reliable manner.

According to a third aspect of the present invention, in the reservoir tank 1 for the coolant described in the second aspect, the first communication passage 6 further includes a vertical passage portion 6*b* extending upward from a tank chamber 4 side, and a curved portion 6*c* continuous with the vertical passage portion 6*b*, curved outward in a convex shape, and continuous with the lateral passage portion 6*a*, and the lateral passage portion 6*a* of the first communication passage 6 and the lateral passage portion 7*a* of the second communication passage 7 are disposed to be an identical height to each other.

According to this configuration, when the liquid surface vibrates in the tank chamber, in a case where the coolant flows upward from the tank chamber through the first communication passage, the coolant is smoothly guided from the vertical passage portion of the first communication passage through the curved portion to the lateral passage portion, and then flows into the lateral passage portion of the second communication passage disposed to be the same height as the lateral passage portion. Accordingly, the coolant that flows upward through the first communication passage from the tank chamber can be directly caused to escape to the second communication passage side and then can be returned to the tank chamber without flowing around the opening, and thus the coolant can be prevented from leaking out of the breathing hole in a further reliable manner.

According to a fourth aspect of the present invention, in the reservoir tank 1 for the coolant described in the third aspect, an upper surface of the lateral passage portion 6*a* of the first communication passage 6 is horizontal, and a lower surface of the lateral passage portion 6*a* of the first communication passage 6 is inclined downward toward the third communication passage 8.

According to this configuration, when the liquid surface vibrates in the tank chamber, the coolant that has flown into the first communication passage from the tank chamber can be caused to escape from the lateral passage portion of the first communication passage to the lateral passage portion of the second communication passage, can be also guided to the third communication passage, and can be returned to the tank chamber, so that the coolant can be prevented from leaking out of the breathing hole in a further reliable manner.

According to a fifth aspect of the present invention, in the reservoir tank for the coolant described in the fourth aspect, a sum of passage areas of the first communication passage 6, the second communication passage 7, and the third communication passage 8 is set to be equal to or larger than an opening area of the opening 5.

According to this configuration, when injecting the coolant from the opening in order to fill or replenish the reservoir tank with the coolant, it is possible to inject the coolant into the tank chamber with no difficulty through the first to third communication passages without overflowing the coolant from the opening, in accordance with a relationship between the passage areas of the first to third communication passages and the opening area of the opening as described above.

DETAILED DESCRIPTION

Hereinafter, preferred embodiments of the present invention will be described with reference to the drawings. A reservoir tank 1 for coolant according to the present embodiment stores the coolant for cooling, for example, an internal combustion engine mounted on a vehicle, also transfers the coolant to and from a cooling circuit in accordance with a state of temperature or pressure in the cooling circuit, and is disposed in an engine room.

Figure 1:
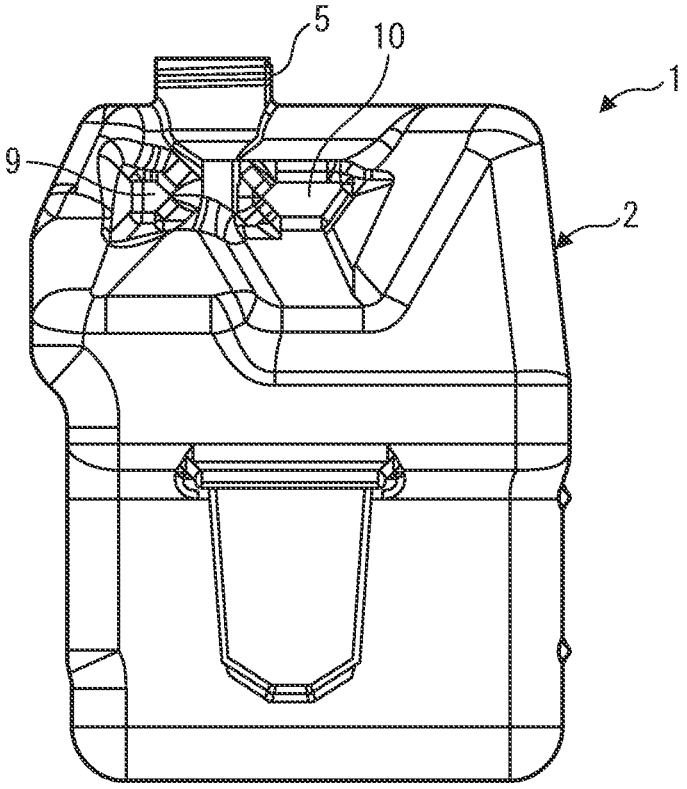
FIG. 1 is a front view illustrating a reservoir tank according to an embodiment of the present invention.
Figure 2:
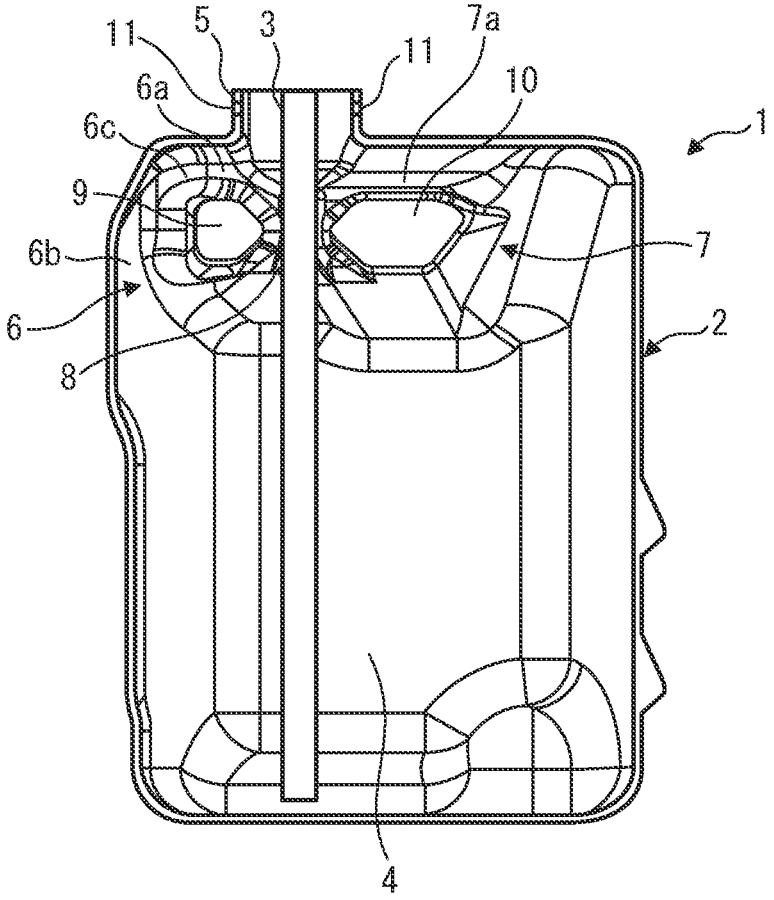
FIG. 2 is a longitudinal sectional view including a hose of the reservoir tank of FIG. 1.
Figure 3:
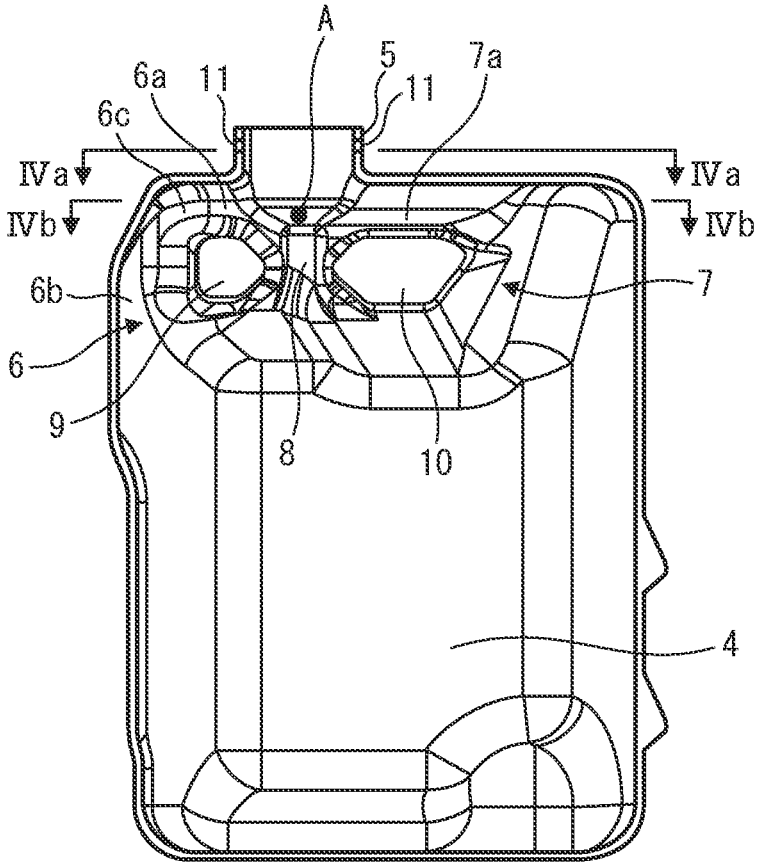
FIG. 3 is a longitudinal sectional view illustrating a cross-sectional line and the like, and excluding the hose from FIG. 2.

As illustrated in FIG. 2, the reservoir tank 1 includes a tank main body 2, and a hose 3 inserted into the tank main body 2. Note that in the drawings other than FIG. 2, the illustration of the hose 3 is omitted. The tank main body 2 is made of a molded article including a synthetic resin, as illustrated in FIGS. 1 and 2, and is formed by blow molding and press molding. A tank chamber 4 for storing the coolant is provided in a lower part of the tank main body 2, and an opening 5 through which the coolant flows into and flows out is provided in an upper part of the tank main body 2.

First to third communication passages 6 to 8 for communicating the opening 5 and the tank chamber 4 are provided between the opening 5 and the tank chamber 4. As illustrated in FIG. 2, collapsed portions 9 and 10 on the left and right, which have been collapsed by press molding, are formed below the opening 5. The collapsed portions 9 and 10 each have a predetermined shape, and are disposed to be spaced apart from each other. The first to third communication passages 6 to 8 are partitioned from one another by the collapsed portions 9 and 10.

Figure 5A:
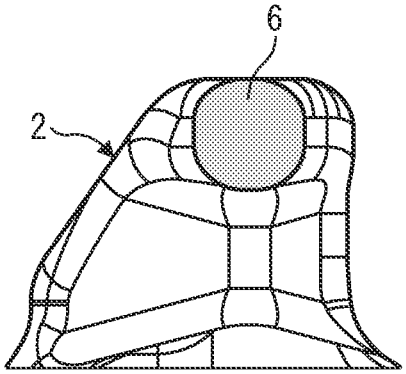
FIG. 5A is a cross-sectional view when a left side is viewed from a position of a point A in FIG. 3.
Figure 6:
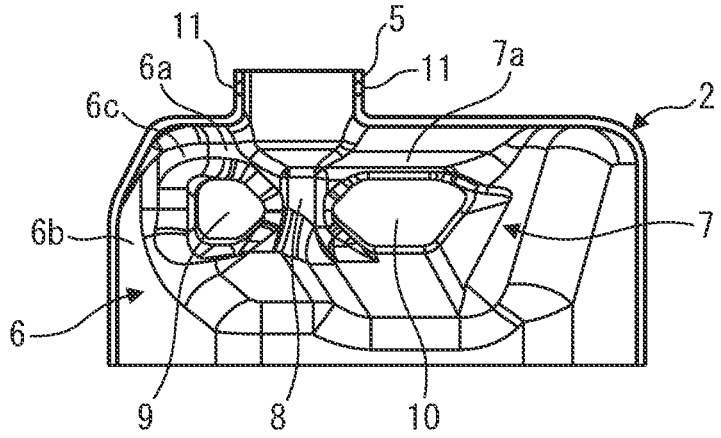
FIG. 6 is a partially enlarged view illustrating an upper part of the reservoir tank in FIG. 3 in an enlarged manner.

To be specific, as illustrated in FIGS. 2 and 6, and the like, the first communication passage 6 is formed to surround the outside of the collapsed portion 9 on a left side, and includes a lateral passage portion 6*a* communicating with below the opening 5 on a right end portion and extending substantially horizontally, a vertical passage portion 6*b* extending upward from the tank chamber 4 side, and a curved portion 6*c* continuous between the lateral passage portion 6*a* and the vertical passage portion 6*b* and curved outward in a convex shape (see FIGS. 4B and 5A).

Figure 4A:
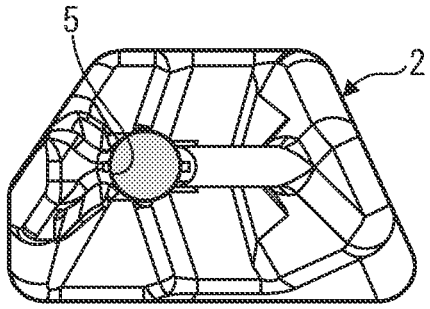
FIG. 4A is a cross-sectional view taken along line IVa-IVa in FIG. 3.
Figure 4B:
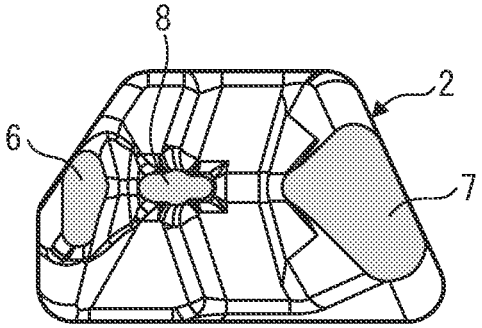
FIG. 4B is a cross-sectional view taken along line IVb-IVb in FIG. 3.
Figure 5B:
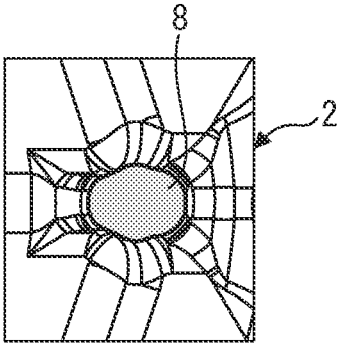
FIG. 5B is a cross-sectional view when a lower side is viewed.
Figure 5C:
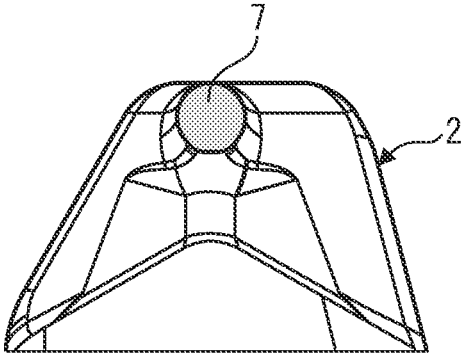
FIG. 5C is a cross-sectional view when a right side is viewed.

The second communication passage 7 is formed to surround the outside of the collapsed portion 10 on the right side, includes a lateral passage portion 7*a* extending substantially horizontally, extending downward from its right end portion, and communicating with the tank chamber 4 (see FIGS. 4B and 5C). The lateral passage portion 7*a* is disposed to be the same height as the lateral passage portion 6*a* of the first communication passage 6, and a left end portion of the lateral passage portion 7*a* faces the right end portion of the lateral passage portion 6*a* below the opening 5.

The third communication passage 8 extends downward from below the opening 5 through between the collapsed portions 9 and 10 on left and right, and communicates with the tank chamber 4 (see FIGS. 4B and 5B). In addition, an upper surface of the lateral passage portion 6*a* of the first communication passage 6 is horizontal, whereas a lower surface of the lateral passage portion 6*a* is inclined downward toward the third communication passage 8.

As illustrated in FIG. 4A, the opening 5 has a circular cross-section, and opens upward. Two breathing holes 11 communicating with the inside and the outside of the opening 5 are each formed in a circumferential wall of opening 5. In addition, the sum of the passage areas of the lateral passage portions 6*a* and 7*a* of the first and second communication passages 6 and 7 and the passage area of the third communication passage 8 is set to be equal to or larger than the opening area of the opening 5.

The hose 3 is made of a flexible material, and has a predetermined outer diameter and a predetermined inner diameter. As illustrated in FIG. 2, the hose 3 is installed to extend from the opening 5 of the tank main body 2 through the third communication passage 8 to the vicinity of the bottom of the tank chamber 4. The hose 3 is connected with the cooling circuit via a joint, another hose (none of which is illustrated), or the like. While the internal combustion engine is operating, the coolant is transferred between the tank main body 2 and the cooling circuit through the hose 3 in accordance with a state of temperature or pressure in the cooling circuit. Note that the tank main body 2 is filled or replenished with the coolant by injecting the coolant from the opening 5 with the hose 3 removed.

Next, a description will be given with regard to the operation of the reservoir tank 1 having the above-described configuration, in particular, the operation when vibration or impact acts on the reservoir tank 1 while the vehicle is traveling on a rough road or the like. When the large vibration or impact acts on the reservoir tank 1, the liquid surface vibration of the coolant occurs in the tank chamber 4, and the coolant moves from the tank chamber 4 through at least one of the first to third communication passages 6 to 8 to the opening 5 side on an upper side.

In this situation, in a case where the coolant moves through all the first to third communication passages 6 to 8, the coolant moves while being dispersed in the first to third communication passages 6 to 8, and also flows into below the opening 5 from three directions different from one another. Thus, the flows of the coolant interfere with one another, and the coolant hardly flows around the opening on an upper side. As described heretofore, unlike the conventional case where the coolant directly moves upward in the auxiliary chamber, the liquid surface vibration in the vertical direction can be sufficiently suppressed. Neither the liquid surface of the coolant nor a droplet reaches the breathing hole 11 formed in the opening 5. Therefore, the coolant can be prevented from leaking out of the breathing hole 11. In addition, the reservoir tank 1 in the present embodiment has a simple configuration, as compared with the conventional reservoir tank having the labyrinth structure.

Further, when the liquid surface vibrates in the tank chamber 4, in a case where the coolant flows upward from the tank chamber 4 through the first communication passage 6, the coolant is smoothly guided from the vertical passage portion 6*b* of the first communication passage 6 through the curved portion 6*c* to the lateral passage portion 6*a*, and then flows into the lateral passage portion 7*a* of the second communication passage 7, which faces the lateral passage portion 6*a* and which is disposed to be the same height. Accordingly, as illustrated in FIG. 7, the coolant that flows upward through the first communication passage 6 from the tank chamber 4 can be directly caused to escape to the second communication passage 7 side, and then can be returned to the tank chamber 4, without flowing around the opening 5.

Figure 7:
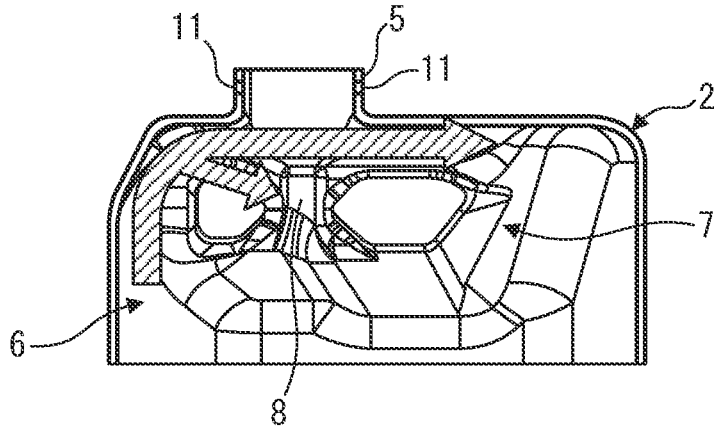
FIG. 7 is a view for describing movements of the coolant when the coolant moves upward passing through a first communication passage in FIG. 6.

In addition, since a lower surface of the lateral passage portion 6*a* of the first communication passage 6 is inclined downward toward the third communication passage 8, the coolant can be satisfactorily guided from the lateral passage portion 6*a* of the first communication passage 6 to the third communication passage 8, and can be returned to the tank chamber 4, as illustrated in FIG. 7. As described heretofore, the coolant can be prevented from leaking out of the breathing hole 11 in a more reliable manner.

Figure 8:
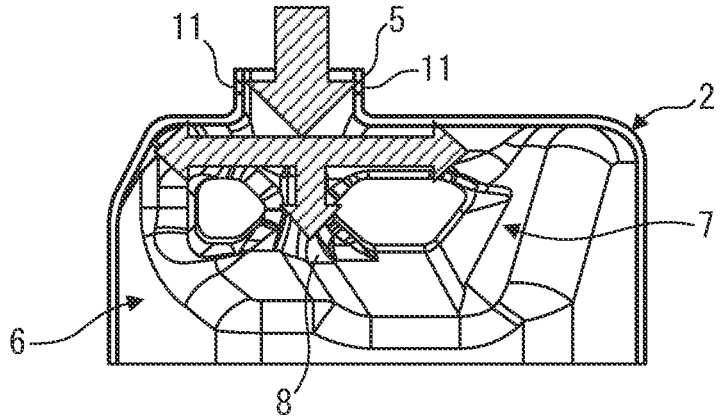
FIG. 8 is a view for describing movements of the coolant when the coolant is injected from an opening in FIG. 6.

Further, the sum of the passage areas of the lateral passage portions 6*a* and 7*a* of the first and second communication passages 6 and 7 and the passage area of the third communication passage 8 is set to be equal to or larger than the opening area of the opening 5. With this configuration, when injecting the coolant from the opening 5 with the hose 3 removed from the tank main body 2 in order to fill or replenish the reservoir tank 1 with the coolant, it is possible to inject the coolant into the tank chamber 4 with no difficulty through the first to third communication passages 6 to 8 without overflowing the coolant from the opening 5, as illustrated in FIG. 8.

Note that the present invention is not limited to the above-described embodiments, and can be implemented in various modes. For example, in one embodiment, it is assumed that the coolant moves upward through the first communication passage 6, and it is configured such that the coolant is caused to escape from the first communication passage 6 to the second communication passage 7 side and the third communication passage 8 side. The present invention is not limited to this. For example, the first to third communication passages may be arranged to be bilaterally symmetric in the reservoir tank, so that the coolant can be caused to escape from the second communication passage to the first communication passage side and the third communication passage side.

In addition, FIGS. 1 and 2 illustrate an example of the reservoir tank in one embodiment, and any embodiment with another appropriate shape or configuration is applicable, as long as it satisfies the configuration requirements of the present invention. Furthermore, in one embodiment, it is related to an example in which the present invention is applied to the reservoir tank for the coolant for use in an internal combustion engine mounted on a vehicle. However, the present invention is not limited to this, and it is needless to say that the present invention is applicable to a reservoir tank for use in an internal combustion engine of anything other than a vehicle. In addition, the detailed configuration can be appropriately changed within the scope of the gist of the present invention.

What is claimed is:

1. A reservoir tank for coolant that stores the coolant for cooling an internal combustion engine, the reservoir tank comprising:

a tank chamber that stores the coolant;

an opening which is arranged in an upper part of the tank chamber, through which the coolant flows in and flows out, and in a circumferential wall of which a breathing hole is formed; and a first communication passage, a second communication passage, and a third communication passage that respectively communicate with the opening and the tank chamber.

2. The reservoir tank for the coolant according to claim 1, wherein the first communication passage and the second communication passage respectively include lateral passage portions extending in a horizontal direction with end portions facing each other below the opening, and the third communication passage extends downward from below the opening.

3. The reservoir tank for the coolant according to claim 2, wherein the first communication passage further includes a vertical passage portion extending upward from a tank chamber side, and a curved portion continuous with the vertical passage portion, curved outward in a convex shape, and continuous with the lateral passage portion, and the lateral passage portion of the first communication passage and the lateral passage portion of the second communication passage are disposed to be an identical height to each other.

4. The reservoir tank for the coolant according to claim 3, wherein an upper surface of the lateral passage portion of the first communication passage is horizontal, and a lower surface of the lateral passage portion of the first communication passage is inclined downward toward the third communication passage.

5. The reservoir tank for the coolant according to claim 1, wherein a sum of passage areas of the first communication passage, the second communication passage, and the third communication passage is set to be equal to or larger than an opening area of the opening.

* * * * *